US008905142B2

(12) United States Patent
Legras

(10) Patent No.: US 8,905,142 B2
(45) Date of Patent: Dec. 9, 2014

(54) GUIDE FRAME FOR RISER TOWER

(75) Inventor: Jean-Luc Bernard Legras, Houston, TX (US)

(73) Assignee: Acergy France SA, Suresnes (FR)

( * ) Notice: Subject to any disclaimer, the term of this patent is extended or adjusted under 35 U.S.C. 154(b) by 839 days.

(21) Appl. No.: 13/120,356

(22) PCT Filed: Sep. 21, 2009

(86) PCT No.: PCT/IB2009/055094

§ 371 (c)(1),
(2), (4) Date: Jun. 7, 2011

(87) PCT Pub. No.: WO2010/035248

PCT Pub. Date: Apr. 1, 2010

(65) Prior Publication Data

US 2011/0240308 A1 Oct. 6, 2011

Related U.S. Application Data

(60) Provisional application No. 61/100,285, filed on Sep. 26, 2008.

(30) Foreign Application Priority Data

Oct. 28, 2008 (GB) ..... 0819734.5

(51) Int. Cl.
*E21B 17/01* (2006.01)
*E21B 17/10* (2006.01)

(52) U.S. Cl.
CPC ..... *E21B 17/012* (2013.01); *E21B 17/1035* (2013.01)
USPC ..... 166/367; 166/345; 166/350; 405/224.2

(58) Field of Classification Search
CPC .... E21B 17/012; E21B 17/1035; E21B 17/01
USPC ..... 166/367, 345, 350, 351, 241.6; 138/111, 112; 405/184.4, 184.5, 224.2
See application file for complete search history.

(56) References Cited

U.S. PATENT DOCUMENTS 3,705,432 A * 12/1972 Watkins, Jr. ..... 441/133
3,729,756 A * 5/1973 Cook et al. ..... 441/133
4,249,610 A * 2/1981 Loland ..... 166/360
4,423,982 A * 1/1984 Zaremba ..... 405/224.2

(Continued)

FOREIGN PATENT DOCUMENTS

FR 2 892 170 4/2007
WO WO 99/57413 4/1999

(Continued)

*Primary Examiner* — Matthew Buck
(74) *Attorney, Agent, or Firm* — Levy & Grandinetti

(57) ABSTRACT

Disclosed herein is a guide frame (10) for location at one or more points along the length of a riser tower structure (112, 114). The riser tower structure is of a type that has an upper end supported at a depth below the sea surface and has a central core (200) with one or more conduits (220) arranged therearound extending from the seabed toward the surface. In use, the guide frame guides the conduit (s) relative to the central core, said guide frame (10) being attachable to said riser tower structure non-continuously (40,50), thereby not becoming an integral part of said riser tower structure. Also disclosed is a riser tower comprising such guide frames.

27 Claims, 7 Drawing Sheets

(56) References Cited

U.S. PATENT DOCUMENTS

| | | | | |
|---|---|---|---|---|
| 4,477,207 | A * | 10/1984 | Johnson | 405/195.1 |
| 5,320,312 | A * | 6/1994 | Hoenninger | 248/68.1 |
| 5,542,776 | A * | 8/1996 | Reynolds | 403/389 |
| 5,803,170 | A * | 9/1998 | Garcia-Soule et al. | 166/242.3 |
| 6,082,391 | A | 7/2000 | Thiebaud et al. | |
| 6,632,112 | B2 | 10/2003 | Nish et al. | |
| 6,837,311 | B1 * | 1/2005 | Sele et al. | 166/353 |
| 7,059,416 | B2 | 6/2006 | Dailey et al. | |
| 7,210,531 | B2 * | 5/2007 | van Belkom et al. | 166/367 |
| 7,398,697 | B2 * | 7/2008 | Allen et al. | 73/800 |
| 7,431,535 | B2 * | 10/2008 | Cupolillo | 405/184.4 |
| 7,988,104 | B1 * | 8/2011 | Cook et al. | 248/68.1 |
| 2011/0042095 | A1 * | 2/2011 | Sessions et al. | 166/360 |
| 2011/0154620 | A1 * | 6/2011 | Whitelaw et al. | 24/122.6 |

FOREIGN PATENT DOCUMENTS

| | | |
|---|---|---|
| WO | WO 02/40821 | 5/2002 |
| WO | WO 02/053869 | 7/2002 |
| WO | WO 2009/134986 | 11/2009 |

* cited by examiner

GUIDE FRAME FOR RISER TOWER

The present invention relates to Hybrid Riser Towers, and in particular to guide frames for such Hybrid Riser Towers, and to Hybrid Riser Towers incorporating such guide frames.

Hybrid Riser Towers are known and form part of the so-called hybrid riser, having an upper portions ("jumpers") made of flexible conduit and suitable for deep and ultra-deep water field development. U.S. Pat. No. 6,082,391 (Stolt/Doris) proposes a particular Hybrid Riser Tower (HRT) consisting of an empty central core, supporting a bundle of (usually rigid) riser pipes, some used for oil production some used for injection of water, gas and/or other fluids, some others for oil and gas export. This type of tower has been developed and deployed for example in the Girassol field off Angola. Insulating material in the form of syntactic foam blocks surrounds the central core and the pipes and separates the hot and cold fluid conduits. Further background has been published in paper "Hybrid Riser Tower: from Functional Specification to Cost per Unit Length" by J-F Saint-Marcoux and M Rochereau, DOT XIII Rio de Janeiro, 18 Oct. 2001. Updated versions of such risers have been proposed in WO 02/053869 A1. The contents of all these documents are incorporated herein by reference, as background to the present disclosure.

It is known for HRTs to have a number of guide frames along their length, to hold in place the guiding devices that guide the risers and other lines relative to the central core (in other HRTs, the risers are guided by the buoyancy/insulation foam elements). In such designs the guiding frame is an integral part or an extension of the central core, usually being welded to it. Risers apply a lateral load (at a maximum during fabrication when the tower is horizontal) to the central core. They also apply a longitudinal load (perpendicular to the frame plane) equal to the lateral load multiplied by the friction coefficient. In some application, the guide frames also transfer the buoyancy loads from the buoyancy modules to the central core.

However, the fact that there is a weldment between the guiding frame and the central core causes fatigue loading on the central core. Furthermore it would be advantageous for guide frames to be lighter and cheaper. It is therefore an aim of the present invention to address one or more of these issues.

In a first aspect of the invention there is provided a guide frame for location at one or more points along the length of a riser tower structure of a type having an upper end supported at a depth below the sea surface and comprising a central core and one or more conduits extending from the seabed toward the surface, said conduit(s) being arranged around said central core, such that in use, said guide frame guides the conduit (s) relative to the central core, and wherein said guide frame is attachable to said riser tower structure non-continuously, thereby not becoming an integral part of said riser tower structure.

Attachable "non-continuously" in this case means attachable wherein there is no material continuity between guide frame and riser tower structure as opposed to connections made by welding or direct mechanical fixing to the central core.

Said guide frame may be attachable to said riser tower structure in such a way so as to be removable.

In a main embodiment said guide frame is comprised of a plurality (preferably two) main pieces which are arranged to be assembled together around said central core, without any direct connection being made to said central core. Said main pieces may be arranged such that, when assembled together around said central core, the frame is held in place by bearing pressure and frictional force acting between central core and frame. Said assembly may be effected by bolting together the main pieces to each other. Additionally, plates may be provided across each join, attached to the main piece either side of said join. Said main pieces may all be similar.

Said guide frame may be comprised largely of a non-metallic material, for example a plastic material, such as polyurethane. If so, there may be provided structural members arranged around said central core, when in-situ. There may be provided one of said structural members at each of the top and bottom of said guide frame.

Alternatively said guide frame may be comprised of a metal, such as steel. In one embodiment, each of said main pieces comprise largely closed hollow structures (although holes may be provided for access to connections). In another embodiment each of said main pieces comprise a skeletal stiffener structure with plates attached thereto.

Said guide frame may comprise an area suitable for a buoyancy module to act upon and impart its force to said guide frame. One or more bearing plates may be provided for this purpose.

Apertures may be provided for the guiding of said conduits. Each of said apertures may be formed from an indent in one of said main pieces of said guide frame, said apertures being completed by a closing piece. Said closing piece may comprise a metal clamp or be comprised of a plastic material. The closing pieces may be fixed to its corresponding main piece with bolts. Alternatively, a strap may be placed around the cross section of the guide frame. In the latter case the closing pieces may be maintained in place by shear keys. Said apertures may be designed for the siting therein of riser guides, to guide each conduit.

Said guide frame may be operable to guide said conduits without holding them, such that they may move axially with respect to one another and the central core.

In a further aspect of the invention there is provided a riser tower of a type having an upper end supported at a depth below the sea surface and comprising a central core and one or more conduits extending from the seabed toward the surface, said conduit(s) being arranged around said central core, wherein said riser tower further comprises one or more guide frames located at corresponding points along the length of the riser tower structure so as to guide the conduit(s) relative to the central core, said guide frame(s) being attached to said riser tower structure non-continuously, thereby not becoming an integral part of said riser tower structure.

Said one or more guide frames may comprise any of the guide frames described in relation to the first aspect of the invention described above.

Said riser tower may further comprise buoyancy modules which act on the underside of some or all of said guide frames. In one embodiment, said buoyancy modules act upon the periphery of said guide frames. Possibly said riser tower is arranged such that buoyancy modules act upon different points of some or all of said guide frames. Said central core may comprise an abutment means for each of said guide frames, such that the top of said guide frame, or a portion thereof, abuts against said abutment means.

Said one or more guide frames may be assembled around said central core such that, where there is a longitudinal weld present in the central core, said weld is positioned between two of said main pieces of said guide frame.

Said riser tower structure may further comprise umbilical cables, fibre optic cables and other elongate objects, some or all of which being guided or supported by said guide frame(s).

Said central core may be treated at the points where said guide frames are attached, prior to their attachment. Said treatment may include the addition of epoxy based coatings or painting.

BRIEF DESCRIPTION OF THE DRAWINGS

Embodiments of the invention will now be described, by way of example only, by reference to the accompanying drawings, in which.

DETAILED DESCRIPTION OF THE EMBODIMENTS

Figure 1:
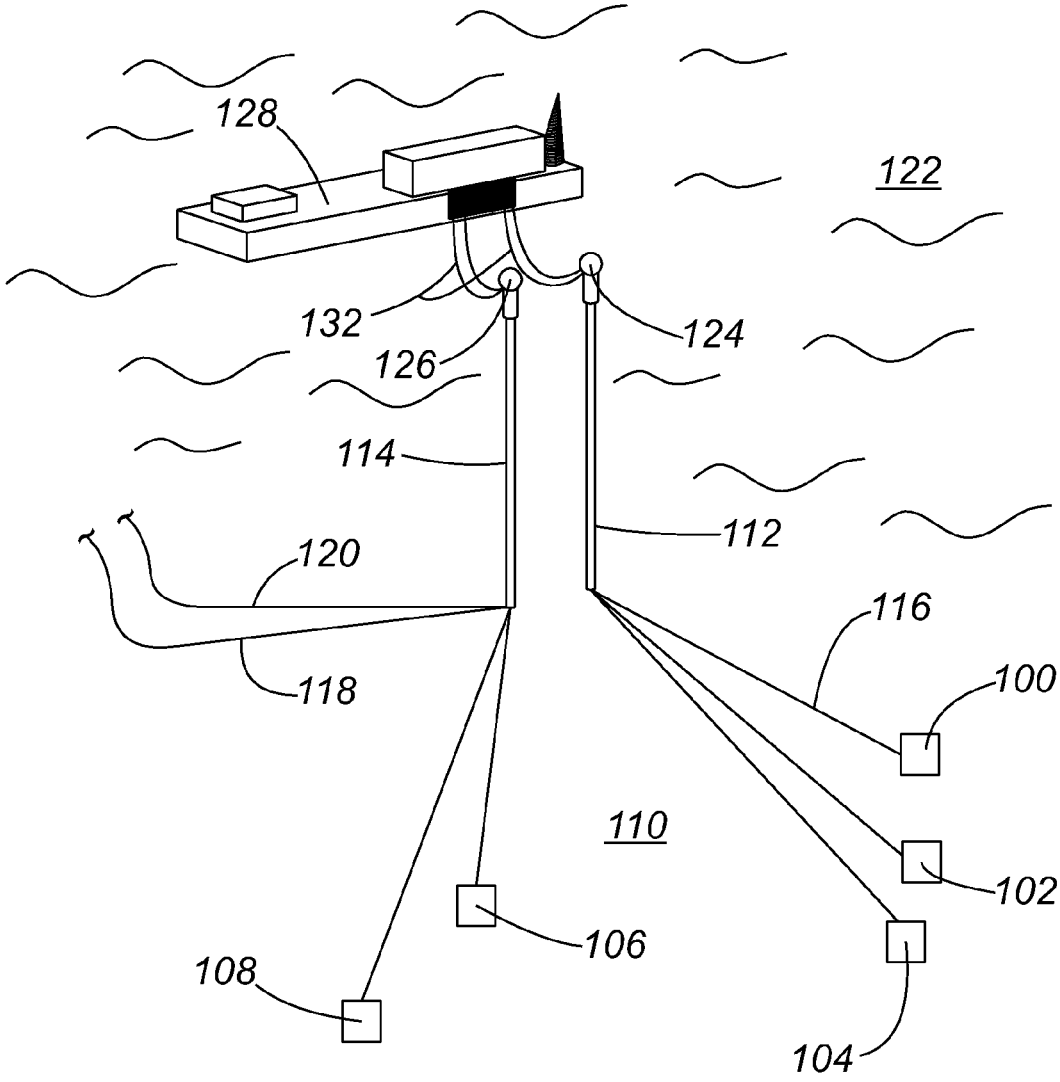
FIG. 1 shows a known type of hybrid riser structure in an offshore oil production system.

Referring to FIG. 1, the person skilled in the art will recognise a cut-away view of a seabed installation comprising a number of well heads, manifolds and other pipeline equipment 100 to 108. These are located in an oil field on the seabed 110.

Vertical riser towers are provided at 112 and 114, for conveying production fluids to the surface, and for conveying lifting gas, injection water and treatment chemicals such as methanol from the surface to the seabed. The foot of each riser, 112, 114, is connected to a number of well heads/injection sites 100 to 108 by horizontal pipelines 116 etc.

Further pipelines 118, 120 may link to other well sites at a remote part of the seabed. At the sea surface 122, the top of each riser tower is supported by a buoy 124, 126. These towers are pre-fabricated at shore facilities, towed to their operating location and then installed to the seabed with anchors at the bottom and buoyancy at the top.

A floating production unit (FPU) 128 is moored by means not shown, or otherwise held in place at the surface. FPU 128 provides production facilities, storage and accommodation for the fluids from and to the wells 100 to 108. FPU 128 is connected to the risers by flexible flow lines 132 etc arranged in a catenary configuration, for the transfer of fluids between the FPU and the seabed, via riser towers 112 and 114.

Individual pipelines may be required not only for hydrocarbons produced from the seabed wells, but also for various auxiliary fluids, which assist in the production and/or maintenance of the seabed installation. For the sake of convenience, a number of pipelines carrying either the same or a number of different types of fluid are grouped in "bundles", and the riser towers 112, and 114 in this embodiment comprise each one a bundle of conduits for production fluids, lifting gas, water and gas injection, oil and gas export, and treatment chemicals, e.g. methanol. All the component conduits of each bundle are arranged around a central core, and are held in place relative to each other (in the two lateral dimensions, longitudinal movement not being prevented) by guide frames attached to the central core.

Figure 2:
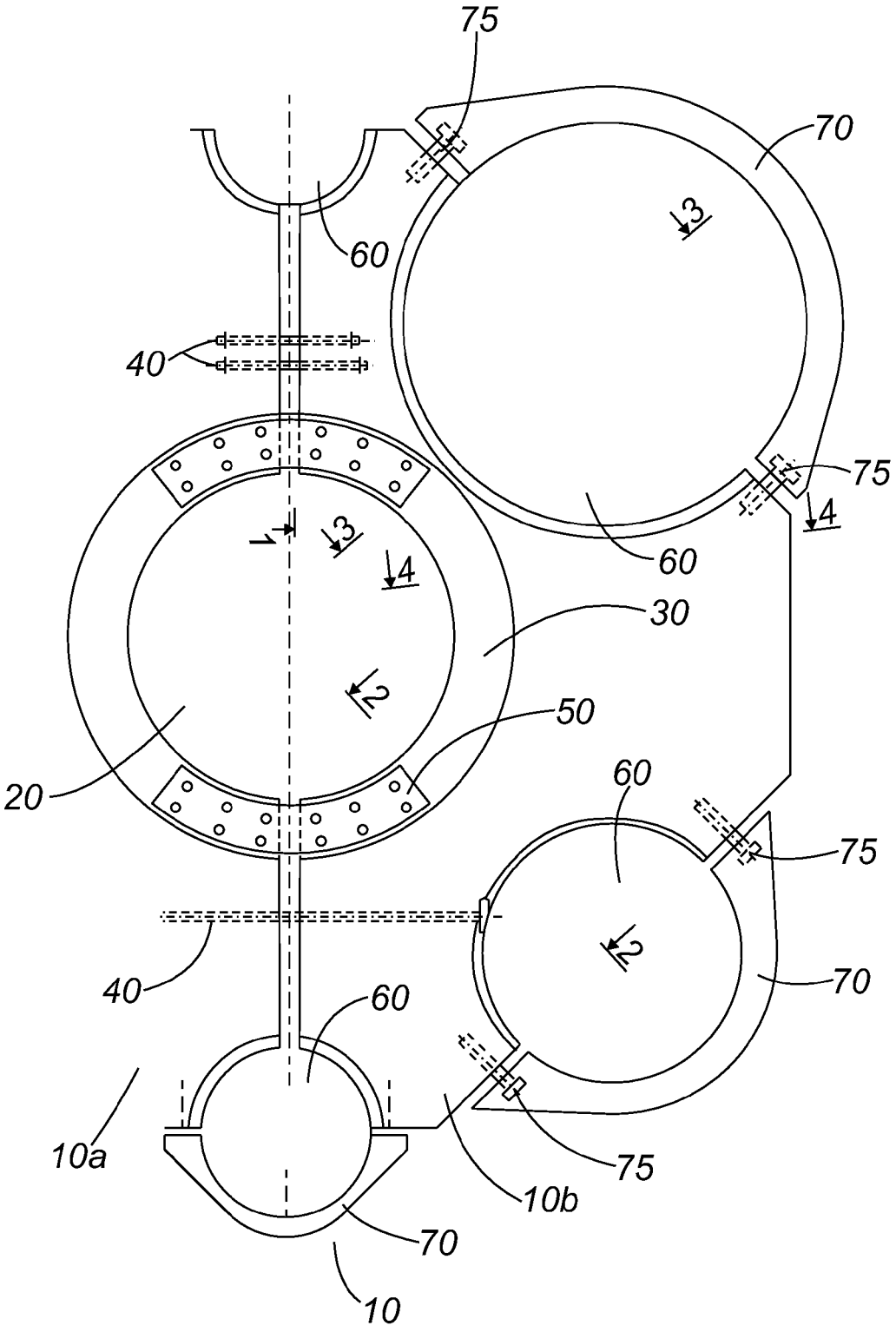
FIG. 2 shows a plan view of a riser guide (in part) according to a first embodiment.

FIG. 2 shows a guide frame for a riser tower structure manufactured from a plastic such as polyurethane. The frame 10 comprises a main body formed in two pieces 10*a*, 10*b*. In this example, both halves are largely identical. The main body 10*a*, 10*b* has a central aperture 20 for the central core of said riser tower, such that, when being installed, the two halves 10*a* and 10*b* are assembled together around the central core (usually with some material between core and frame).

It is the very fact that the guide frame can be installed in this manner, without the use of welding or any other continuous connection, that allows the guide frame, or at least the main structure thereof, to be made of plastic (or other non-metallic material). The only metallic elements may then be any connectors/bolts and metallic inserts 30/plates 50 for connection around the central core. This results in guide frames having reduced cost and weight. The fact that the two pieces 10*a*, 10*b* may be identical further reduces costs as they can be made from a single moulding.

Around the central aperture 20, is a metallic insert 30. To attach the two halves together, bolts 40 are used, after which plates 50 are bolted to the half frames. These plates 50 ensure continuity of the metallic inserts 30, through which the forces that are to be transferred to the central core or to the other half of the guiding frame are transmitted.

The main body provides hollows 60 for location of the riser guides, each hollow being provided with corresponding closing pieces 70, for bolting (in the example shown) to the main body, thereby securing the riser guide. The riser guide simply guides the riser relative to the other risers and central core so as to prevent clashing and to maintain the basic riser tower arrangement. However, the riser guides do not actually grip the risers and therefore do not prevent longitudinal movement of the riser relative to other risers or the central core.

FIGS. 3*a*-3*d* show the same guide frame, in situ around a central core 200, and with riser guides 210 and risers 220 in place. The guiding devices 210 comprise a "spring" part 210*a* and a hard polyurethane part 210*b*. The same guiding device as used for the Greater Plutonio project may be used here and with the other guiding frames described herein.

Figure 3A:
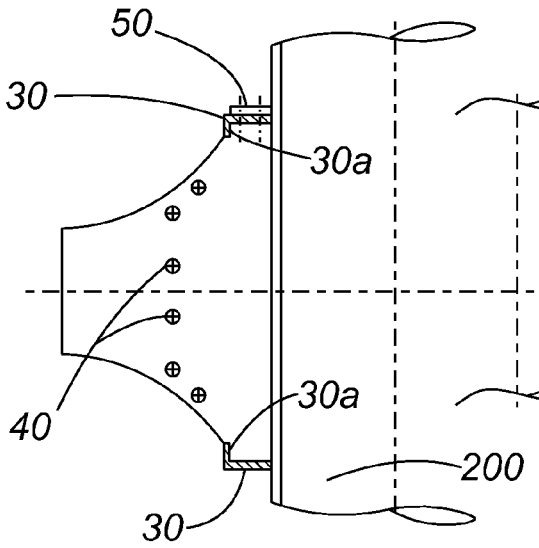
FIGS. 3*a* to 3*d* show the same guide frame in cross section through lines 1, 2, 3 and 4 respectively, as shown in FIG. 2.
Figure 3B:
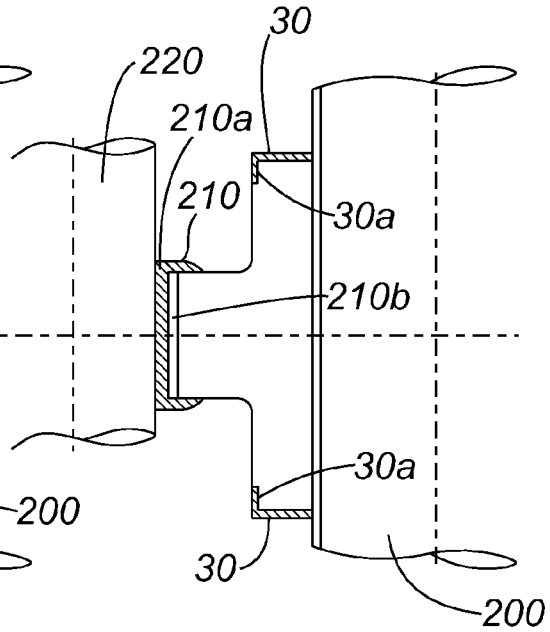
Figure 3C:
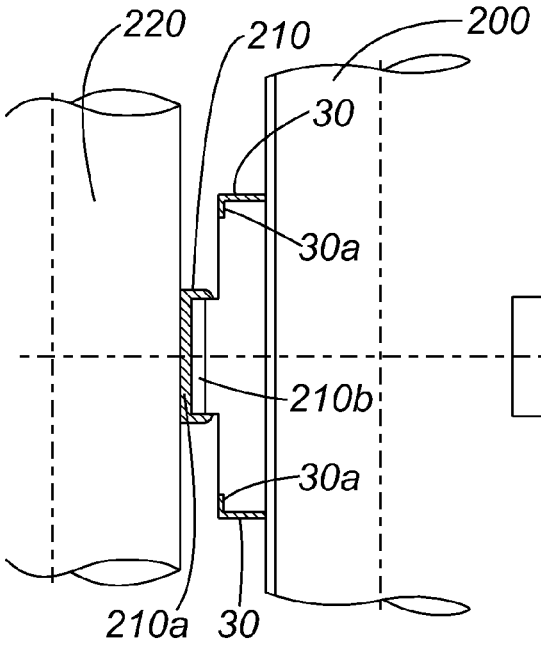
Figure 3D:
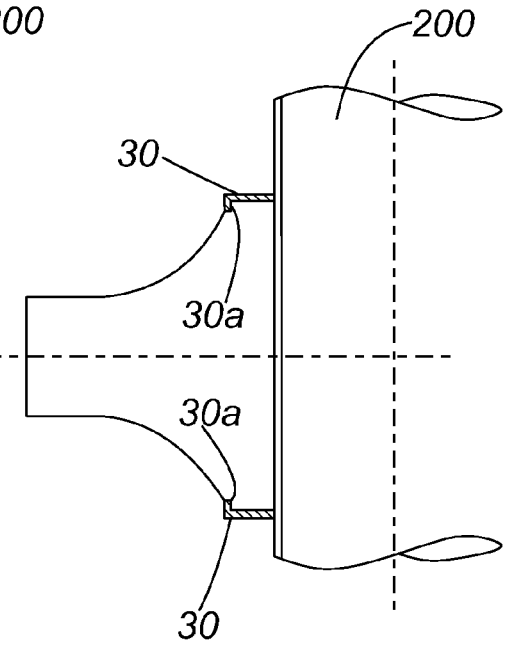

FIG. 3*a* shows a cross section through line 1, FIG. 3*b* shows a cross section through line 2, FIG. 3*c* shows a cross section through line 3 and FIG. 3*d* shows a cross section through line 4.

It can be seen that the guide frame profile is such that its thickness is significantly greater around the apertures for the central core and riser guides than the rest of the body. These figures also show that the metal insert 30 (optionally) has a lip 30*a*, so as to ensure a better bounding between steel and PU, although (strictly speaking) bounding should be sufficient without such as lip. It is suggested to insert these metal inserts 30 in the mould of the main body, during its forming, in order that they are fully bounded to the polyurethane body.

The closing pieces 70 maintain the risers and their guiding devices onto the frame. These closing pieces are also made of polyurethane, in this embodiment. One method of attaching the closing pieces is to fix them to the frame with bolts 75, the frame being provided with (inset into the polyurethane) long internally threaded metallic tubes for receiving the bolts. Alternatively, a long strap placed around the whole cross section may be used, with the closing pieces 70 maintained in place by shear keys.

Buoyancy modules are placed around the central core and bolted or strapped so that the buoyancy load is normally transferred to the central core by friction. However, the situation whereby the bolts or straps lose their tension and the module moves along the riser, making contact with the frame's lower steel ring (formed by the metallic insert 30 and plates 50) and applies its force, should be considered. To counteract this situation, stoppers may be welded (in advance) onto the central core at the frame locations in order to transfer to the central core axial loads applied on the frame, and in particular the loads generated by the buoyancy module.

As the two half parts 10*a*,10*b* of the frame are identical (in this example), the guiding frame is symmetrical about the central plane perpendicular to the central core longitudinal axis. Consequently, depending on the way the two parts are assembled, the riser configuration may be either symmetrical relative to the central core axis, or to the interface plane between the two parts.

Figure 4:
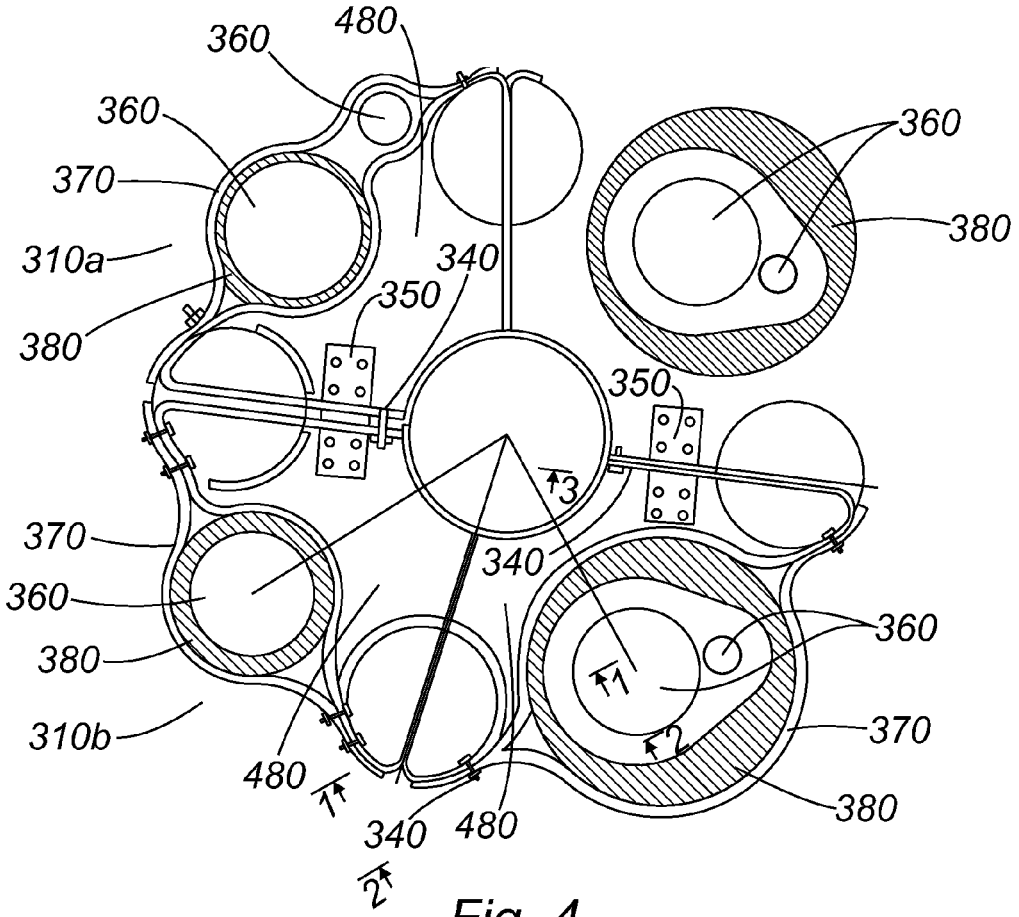
FIG. 4 shows a plan view of a riser guide (in part) according to a second embodiment.
Figure 5A:
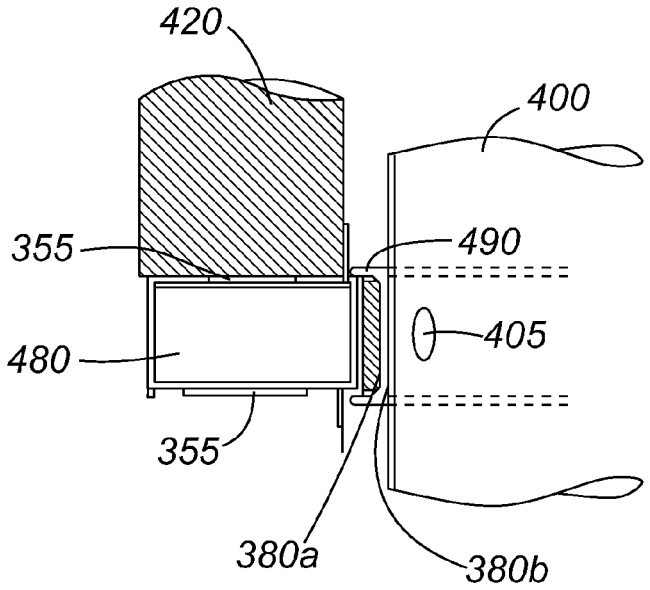
FIGS. 5*a* to 5*c* show the same guide frame in cross section through lines 1, 2 and 3 respectively, as shown in FIG. 4.
Figure 5B:
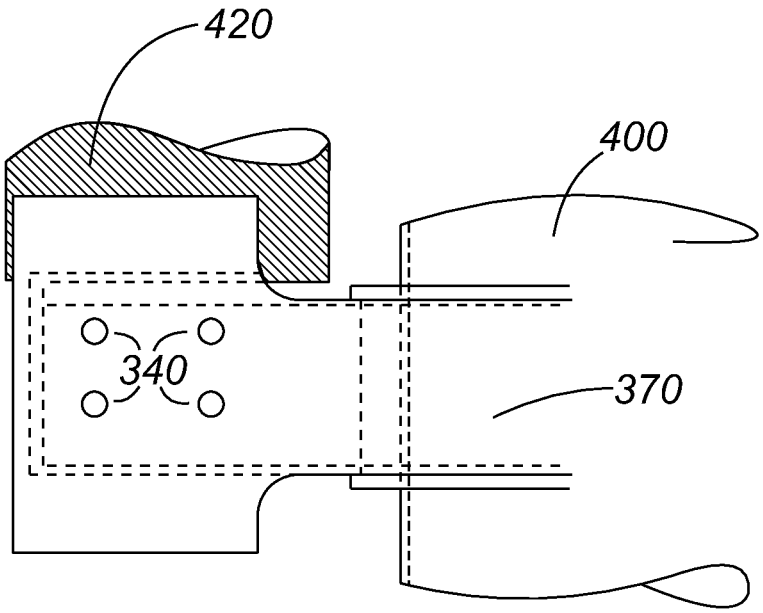
Figure 5C:
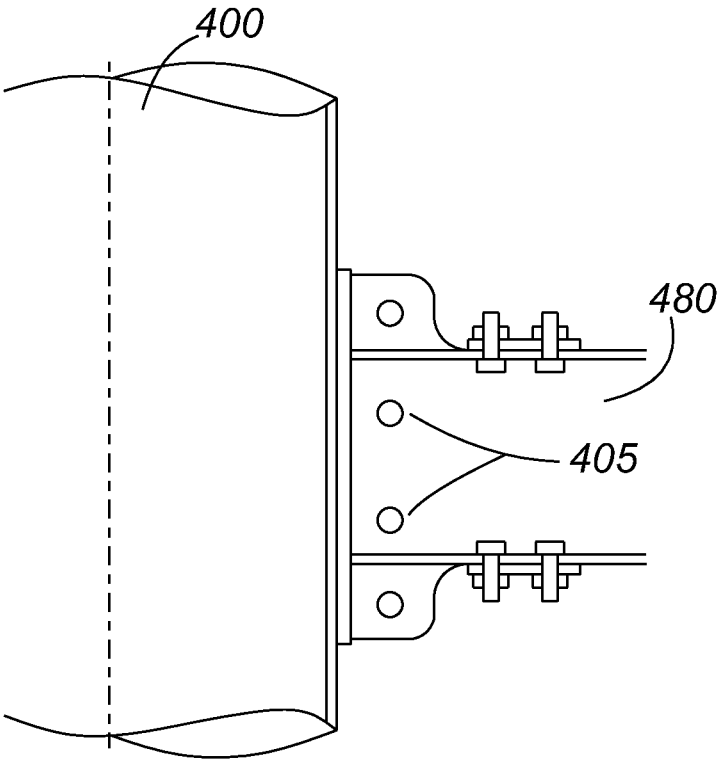

FIGS. 4 and 5*a*-5*c* show an alternative guiding frame, designed to be manufactured in steel (or other suitable metal). This particular example shows a caisson type, or closed, guiding frame. This has the advantage of being very rigid and therefore allowing the plate thickness to be small (6-8 mm in one embodiment). FIG. 4 shows the frame from above, and FIGS. 5*a*-5*c*, show the frame in cross section through lines 1, 2 and 3 respectively.

The design is similar to that described above, in that the guiding frame 310*a*, 310*b* is formed from two parts that are assembled around the central core 400 by bolts 340 (or other suitable means). Also, as before, the loads that are to be transferred to the central core or to the other half part of the guiding frame are transmitted through the top and bottom plates 490 of the caisson, around the central core. The continuity of these plates is ensured by connector plates 350 that are bolted to the half frames, after the half frames are tightened together against the central core 400 by said bolts 340. Also shown are the risers 360, guiding devices 380, buoyancy tubes 420, bearing plates 355, and clamps 370. As before, the guiding devices 380 comprise a "spring" part 380*a* and a hard polyurethane part 380*b*.

The caissons 480 are preferably completely closed except for holes to ensure full water ingress, the holes fitted with special closing devices that do not allow water circulation in normal operation. The inside may be left unpainted. About 0.1 m diameter holes 405 may be made at locations where stresses are low, to have access to place bolts from the inside (another option is to still use bolts, with the rod welded to the plate. These holes could be subsequently closed using a plastic cap. The plates perpendicular to the frame plane are formed as far as possible in order to reduce the number of pieces to be welded.

Figure 6:
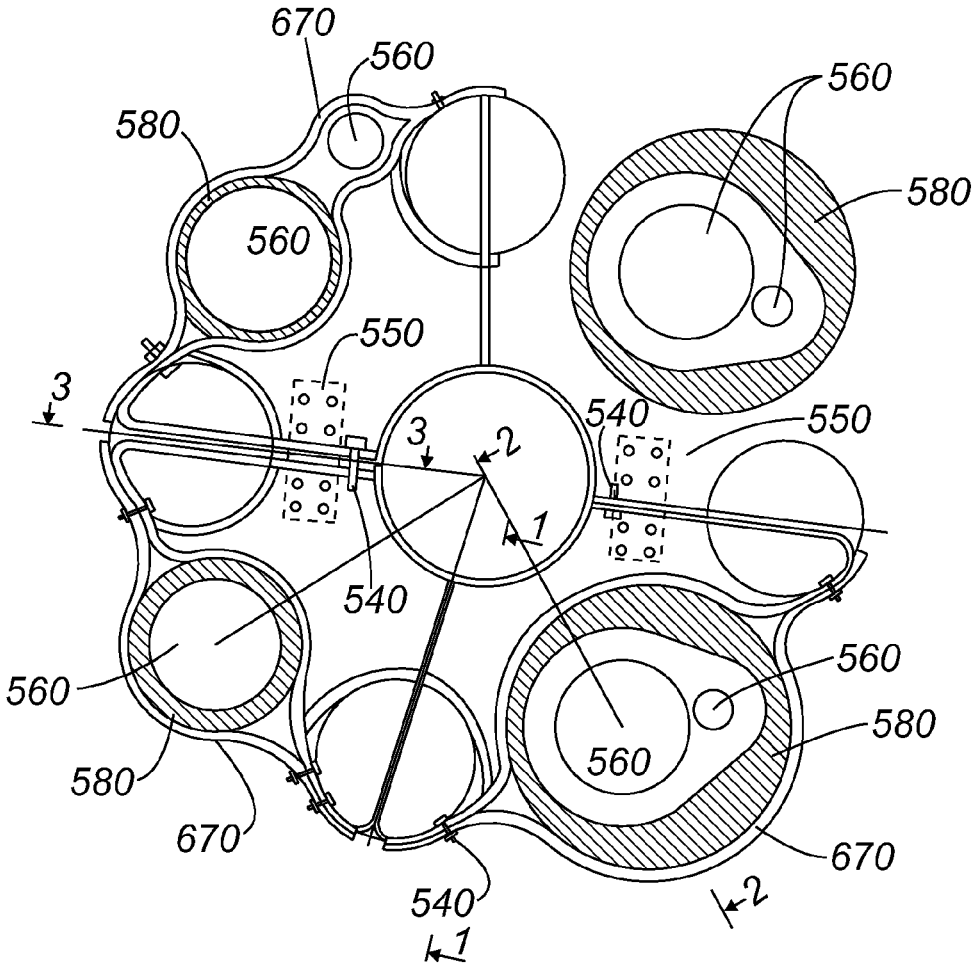
FIG. 6 shows a plan view of a riser guide (in part) according to a third embodiment.
Figure 7A:
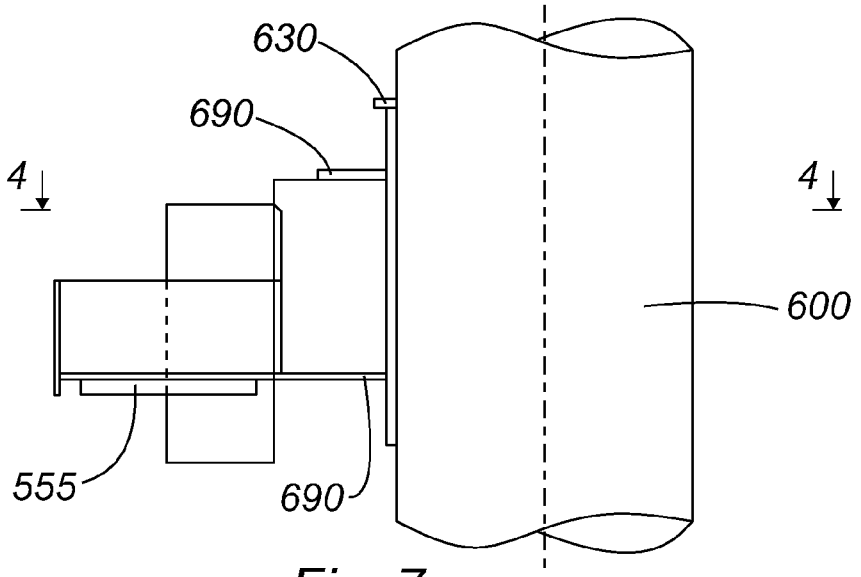
FIGS. 7*a* to 7*c* show the same guide frame in cross section through lines 1, 2 and 3 respectively, as shown in FIG. 6.
Figure 7B:
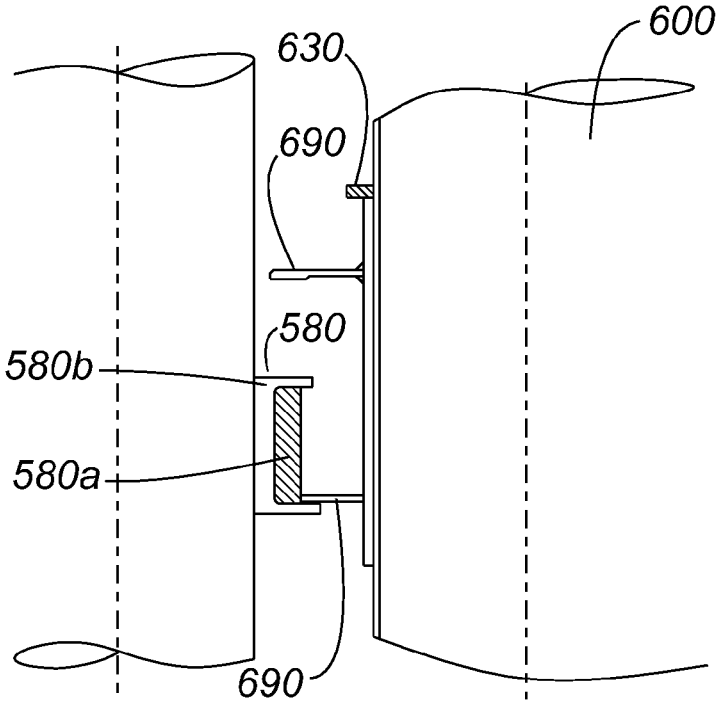
Figure 7C:
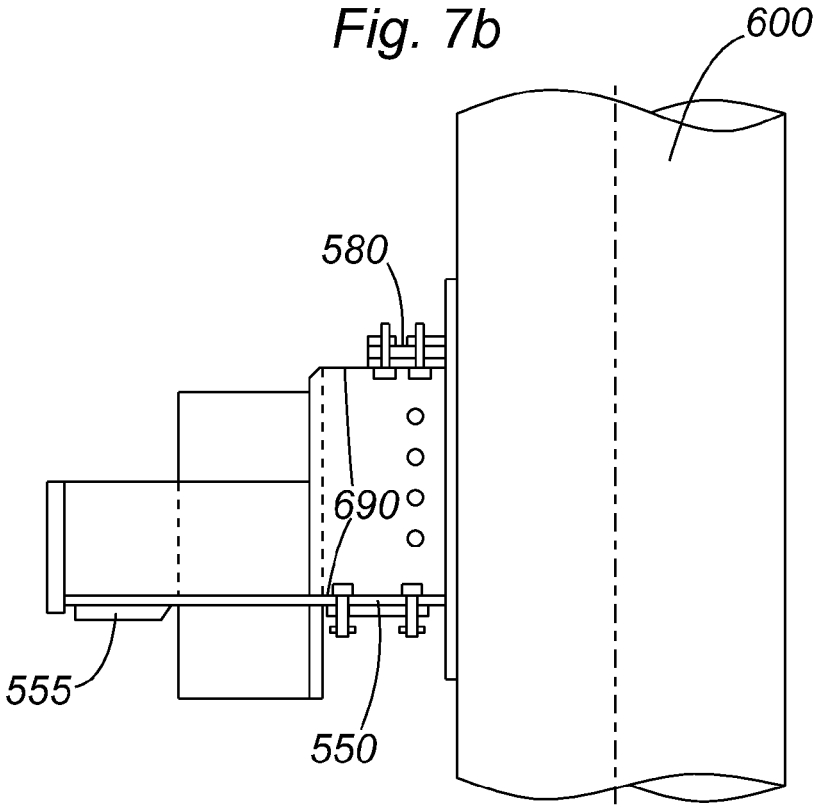

FIGS. 6 and 7*a* to 7*c* show an "open" type alternative to the steel guiding frame described above. This frame is comprised of plates and stiffeners 530, and requires thicker plates to compensate for the lack of rigidity that is inherent in the open structure. FIG. 6 shows the frame from above, and FIGS. 7*a*-7*c*, show the frame in cross section through lines 1, 2 and 3 respectively.

Again the guiding frame 510*a*, 510*b* is formed from two parts that are assembled around the central core 600 by bolts 540 (or other suitable means). Also, as before, the loads that are to be transferred to the central core or to the other half part of the guiding frame are transmitted through top and bottom rings 690 around the central core. The continuity of these rings is ensured by plates 550 that are bolted to the half frames, after the half frames are tightened together against the central core 600 by said bolts 540. Also shown are the risers 560, stopper 630 welded to central core, guiding devices 580, buoyancy tubes 520, bearing plates 555, and clamps 570. As before, the guiding devices 580 comprise a "spring" part 580*a* and a hard polyurethane part 580*b*.

In both the open and closed examples described, the risers and their corresponding guiding devices are maintained using clamps 470, 670 bolted onto the frame. These clamps may be made of an appropriately formed plate (no weld) with sufficient thickness to ensure rigidity. Alternately, polyurethane closing pieces may be considered.

In addition to holding the risers in position relative to each other, the guide frames shown in FIGS. 4-7 are also (optionally) designed to be used to maintain the buoyancy tubes. As a consequence, stoppers are welded on the central core at the frame location so that the guide frame can transfer to the central core axial loads applied on the frame, in particular the ones from the buoyancy modules. The modules have a cylindrical shape and are located on the periphery of the cross section, in a similar manner as risers; and therefore they do not have any contact with the central core. The guide frames are equipped with bearing plates (usually plastic/non-metallic) for the buoyancy tubes to act upon.

The central core is made from "standard" pipe (that is having random length, as they are when leaving the pipe mill). Therefore, there is no special reinforcement at the guiding frame location and the girth welds may be positioned anywhere relative to the frame. As a consequence these welds should be ground in case they are under the frame.

In all the above examples, there are several alternatives materials which can be placed between the central core and the frame; depending on the maximum contact pressure, and then on the fabrication accuracy and in particular the out-of-roundness of the central core The central core may be FBE coated and epoxy mastic placed on the central core before fitting the frame half parts. Alternatively it may be sufficient to paint the central core and apply the frame directly thereon. Furthermore the pipe's longitudinal weld may also be placed between the two halves of the guide frame as it is being assembled. Otherwise the location of the longitudinal weld may be determined by the location of the frame. Softer materials may be considered for the interface gap for the steel frames as this would reduce hard points. However, there is a risk that the material yields and creeps, which would allow some relative displacement between frame and central core.

The guiding frames described herein can ideally be used to support the bundle on a lorry (a support with wheels placed on rails, so that the whole bundle can be transported and launched in water) during fabrication and launching.

The above embodiments are for illustration only and other embodiments and variations are possible and envisaged without departing from the spirit and scope of the invention. For example, the riser arrangements depicted are simply for illustration and may be varied, including provision of less or more than the four conduit apertures shown. Furthermore, in addition to guiding risers, the guiding frame could also be used to guide or support umbilicals, optical fibres and the like included in the riser tower.

The invention claimed is:

1. A guide frame for location at one or more points along the length of a riser tower structure of a type having an upper end supported at a depth below the sea surface and comprising a central core and one or more conduits extending from the seabed toward the surface, said conduits being arranged around said central core, wherein said guide frame is adapted to guide the conduits relative to the central core, and wherein said guide frame is attachable to said riser tower structure non-continuously, thereby not becoming an integral part of said riser tower structure, the guide frame being comprised of a plurality of main pieces which are arranged to be assembled together around said central core, and further including apertures for guiding the conduits, each of said apertures being formed from an indent in one of said main pieces of said guide frame, and wherein metallic plates are provided across each joint between the plurality of main pieces, attached to the main piece on either side of said joint.

2. A guide frame as claimed in claim 1 wherein said guide frame is attached to said riser tower by means other than welding.

3. A guide frame as claimed in claim 1 being comprised of two main pieces.

4. A guide frame as claimed in claim 1 wherein said main pieces are arranged such that, when assembled together around said central core, the frame is held in place by bearing pressure and frictional force acting between said central core and said frame.

5. A guide frame as claimed in claim 1 wherein said assembly is effected by bolting together the main pieces to each other.

6. A guide frame as claimed in claim 1 wherein a main structure of the guide frame comprises a non-metallic material.

7. A guide frame as claimed in claim 1 wherein the main structure comprises a plastic material.

8. A guide frame as claimed in claim 7 wherein the main structure comprises an elastomer.

9. A guide frame as claimed in claim 7 wherein the main structure comprises polyurethane.

10. A guide frame as claimed in claim 1 being further provided with structural members arranged around said central core, when in-situ.

11. A guide frame as claimed in claim 10 wherein there is provided one of said structural members at each of the top and bottom of said guide frame.

12. A guide frame as claimed in claim 1 wherein said apertures are completed by a closing piece.

13. A guide frame as claimed in claim 12 wherein said closing piece comprises a metal clamp.

14. A guide frame as claimed in claim 12 wherein said closing piece is comprised of a plastic material.

15. A guide frame as claimed in claim 12 wherein each closing piece is directly fixed to the corresponding main piece.

16. A guide frame as claimed in claim 12 wherein a strap is placed around the cross section of the guide frame to maintain the closing pieces in place.

17. A guide frame as claimed in claim 16 wherein the closing pieces are maintained in place by shear keys.

18. A guide frame as claimed in claim 1 wherein said apertures are designed for the siting therein of riser guides, to guide each conduit.

19. A guide frame as claimed in claim 1 adapted to guide said conduits without holding them, such that they may move axially with respect to one another and the central core.

20. A riser tower of a type having an upper end supported at a depth below the sea surface and comprising a central core and one or more conduits extending from the seabed toward the surface, said conduits being arranged around said central core, wherein said riser tower further comprises one or more guide frames located at corresponding points along the length of the riser tower structure so as to guide the conduits relative to the central core, said guide frames being attached to said riser tower structure non-continuously, thereby not becoming an integral part of said riser tower structure, each of said guide frames being comprised of a plurality of main pieces which are arranged to be assembled together around said central core and further including apertures for guiding the conduits, each of said apertures being formed from an indent in one of said main pieces of said guide frame, wherein metallic plates are provided across each joint between the plurality of main pieces, attached to the main piece on either side of said joint.

21. A riser tower as claimed in claim 20 wherein said riser tower further comprises buoyancy modules which act on the underside of some or all of said guide frames.

22. A riser tower as claimed in claim 21 wherein said buoyancy modules act upon the periphery of said guide frames.

23. A riser tower as claimed in claim 21 wherein said riser tower is arranged such that buoyancy modules act upon different points of some or all of said guide frames.

24. A riser tower as claimed in claim 20 wherein said central core comprises an abutment surface for each of said guide frames, such that, when deployed, the top of said guide frame, or a portion thereof, abuts against said abutment surface.

25. A riser tower as claimed in claim 20 wherein said one or more guide frames are assembled around said central core such that, where there is a longitudinal weld present in the central core, said weld being positioned between two of said main pieces of said guide frame.

26. A riser tower as claimed in claim 20 further comprising umbilical cables, fibre optic cables and other elongate objects, at least some of which are guided or supported by said guide frame.

27. A riser tower as claimed in claim 20 wherein said central core has been treated at the points where said guide frames are attached, prior to their attachment.

* * * * *